United States Patent [19]

Baine

[11] 3,979,097

[45] Sept. 7, 1976

[54] LADDER CADDY

[76] Inventor: John Alfred Baine, 1247 Haig Blvd., Mississauga, Ontario, Canada

[22] Filed: Aug. 19, 1975

[21] Appl. No.: 605,900

[52] U.S. Cl. ..... 248/211; 182/129

[51] Int. Cl.[2] ..... E06C 7/14

[58] Field of Search ..... 182/129; 248/210, 211, 248/226 B; 24/243, 243 Q

[56] References Cited

UNITED STATES PATENTS

| | | | |
|---|---|---|---|
| 977,704 | 12/1910 | Brownlee | 24/243 Q |
| 1,631,209 | 6/1927 | Jewell | 24/243 Q |
| 2,654,932 | 10/1953 | Goudie | 24/243 |
| 2,883,134 | 4/1959 | O'Halloran | 248/210 |
| 2,895,700 | 7/1959 | Johnson | 248/210 |
| 3,743,227 | 7/1973 | Sowery | 248/210 |

*Primary Examiner*—Reinaldo P. Machado

[57] ABSTRACT

An accessories attachment device is provided for use when working on a ladder, having an adjustable frame portion for attachment to a ladder in hooked securing relation thereto, with accessory attachment means to receive a workman's accessory such as a paint can holding device, a pail or a pulley wheel, and rapid release means to detachably secure the accessory attachment means to the frame means in readily released relation therewith.

6 Claims, 4 Drawing Figures

FIG. 1
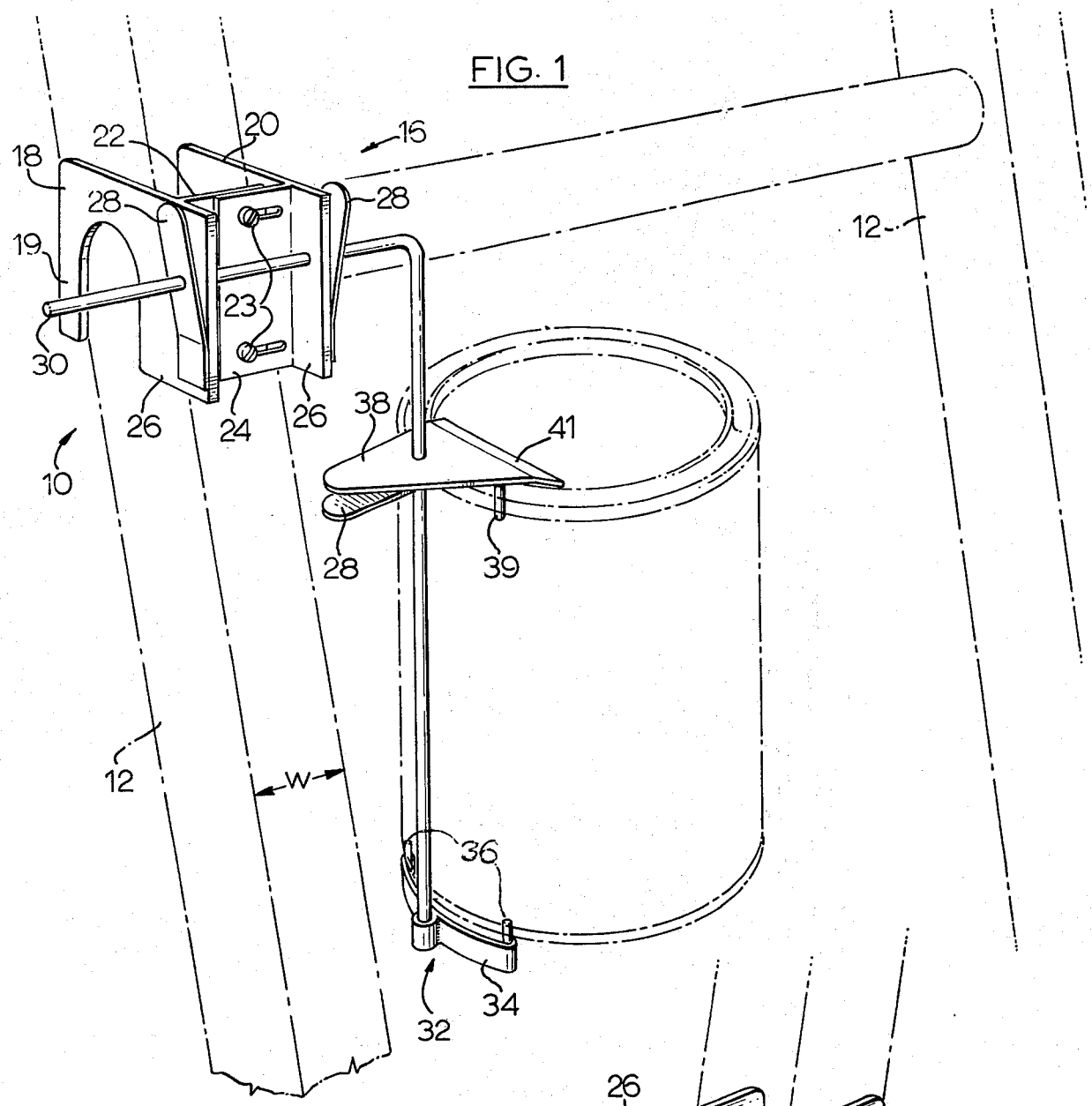
FIG. 2
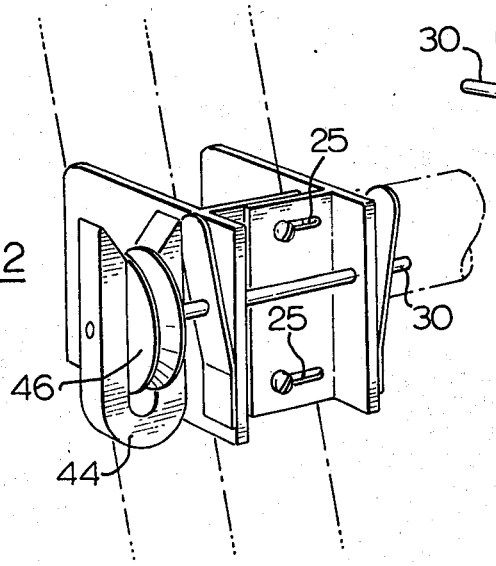
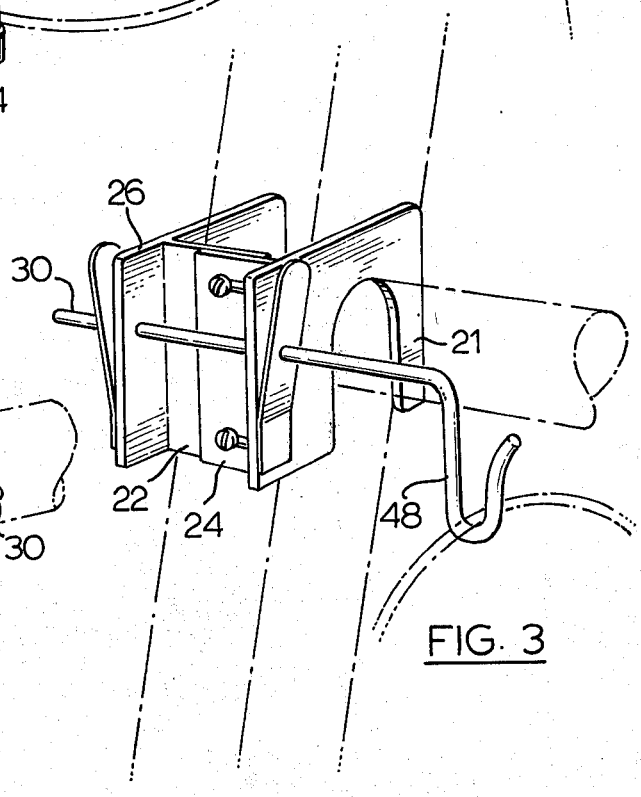
FIG. 3

LADDER CADDY

This invention is directed to an attachment for use with a ladder such as a builders ladder or step ladder, and in particular to a detachable attachment to receive workman's accessories in readily released secured relation to the ladder.

In working at heights on a builders ladder or on a step ladder the problem or securing necessary accessories such as buckets, paint cans, and other necessary items is ever present.

For reasons of safety it is desired to secure such items to the ladder structure to facilitate safe utilisation thereof.

A great many devices have been provided in the past, to this end, but in general have suffered one or other of the following defects:

- not suited to mass production for low initial cost;
- too specifically designed to the dimensions of the ladder suited to receive it;
- attached with screws such as clamps;
- adapted to secure only a single accessory, and accessory securing device insufficiently adaptable in its range of use, to name but a few of the shortcomings of earlier devices.

These characteristics may be discovered individually and severally in the following listed United States patents, which are typically illustrative of the prior art, being issued from Class 248–210

No.2236187 Penney, Mar. 25, 1941
No.2367256 Atkins, Jan. 16, 1945
No.3182943 Crossman, May 11, 1965
No.3239181 Ellerbrock, Mar. 8, 1966
No.3246867 Ewing Apr. 19, 1966. also,
No.3729158 Nagy, Apr. 24, 1973 in Class 248–110.

The problems associated with the foregoing list of defects are generally self-evident, but in passing it may be mentioned that the use of one or more thumbscrews as the means for securing the attachment to the ladder suffer from the disadvantages of being relatively slow in use, subject to slackening off, and liable to damage the ladder.

The suitability of the attachment for mass-production does not lend itself to a ready and rapid analysis, but the present invention is so characterised, and this feature does in fact constitute a practical distinction over much of the prior art, and is readily evident to a man skilled in the art.

The present invention provides one form of attachment frame suited for use with a builder's or runged ladder, having hooked side frame plates adjustably secured together by means such as machine screws, to permit initial setting of the plates to the thickness of the ladder rail, thereby permitting use with ladders of a wide range of rail thickness. The frame is attachable in drop-over hooking engagement with a rung of the ladder and is symetrical, to permit use on either rail.

A pair of spaced ribs extending from the frame have aligned apertures therein through which the spindle of a selected accessory may be inserted, with springloaded thumb clips providing retention of the accessory spindle to the frame, while permitting rapid release therefrom, without need of undoing screws, clamps etc. The range of illustrated accessories includes a combined paint can holder and brush scraper wherein the can holder is adjustable with a spring loaded thumb clamp to receive a paint can ranging in size from a half pint to one gallon; and a spindle mounted hook adjustable in transverse reach to receive a pail handle, and a pulley block having a grooved pulley wheel for hoisting tools, materials etc. up and down by means of a rope.

A second form of attachment frame embodying the characteristics of the present invention is directed more particularly to use with a step ladder. This arrangement has a top plate with hooked side-frames adjustable secured thereto by a nut and bolt, to engage the top step or other suitable step of the ladder in securing relation therewith. Spring loaded thumb clamps are incorporated therewith as in the rung ladder embodiment to permit rapid one-handed release for mounting and dismounting of the transverse spindle of the accessories, as in the other embodiment.

Certain embodiments of the invention are described, reference being made to the accompanying drawings wherein;

FIG. 1 is a general view and shows a rung-ladder embodiment having a universal paint can holder and brush scraper attachment;

FIG. 2 is a like view, illustrating a pulley accessory;

FIG. 3 is a like view illustrating a spindle mounted hook supporting a pail handle.

Figure 4:
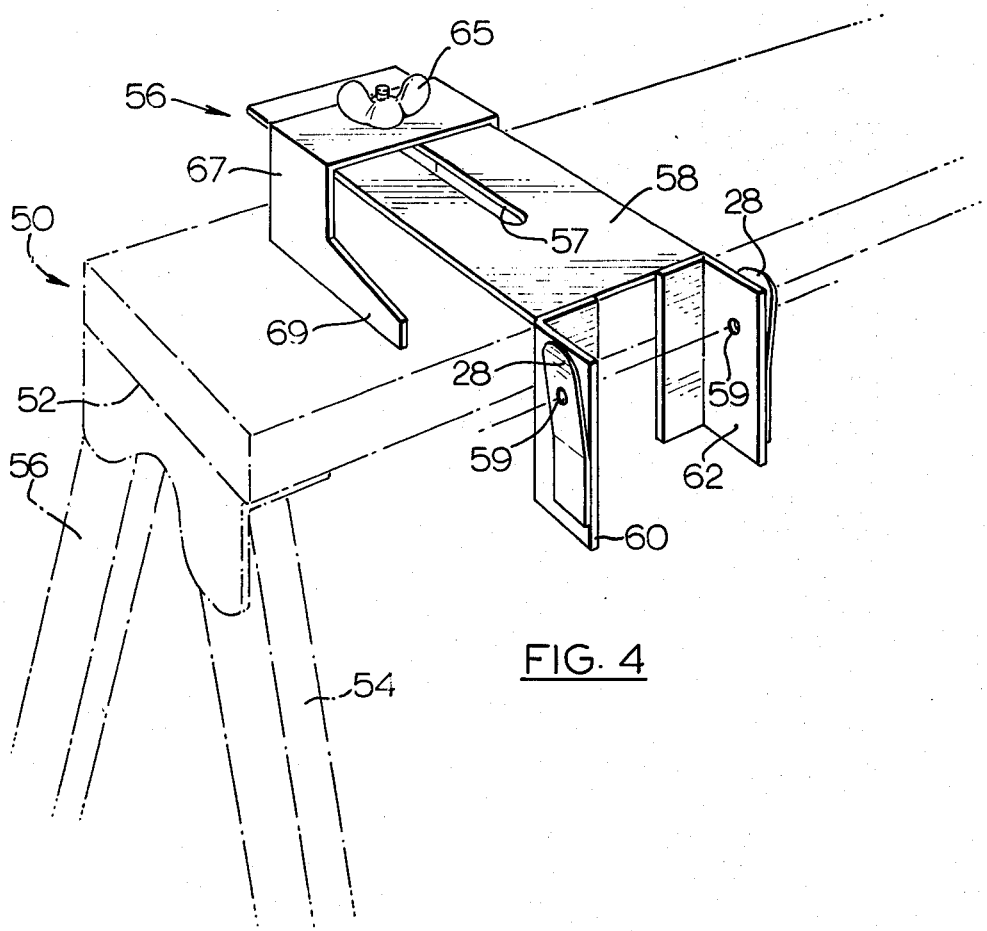
FIG. 4 is a general view and shows an embodiment of the present invention for use with a step ladder, with the accessories omitted.

Turning to FIG. 1, the arrangement 10 shows a portion of a rung ladder, with side rails 12,12 and a rung 14, in phantom to facilitate viewing.

The removable device 16 has a pair of side frames 18,20, each having a respective downwardly extending hook arm 19,21 (see FIG. 3).

The side frame 18 has an angle plate 22 extending normally therefrom, having a pair of screws 23 threadably secured thereto.

The side frame 20 has an angle plate 24 extending normally therefrom, the plate 24 having recess walls 25 therethrough to form slots through which the screws 23 can extend.

Thus the side frames 18,20 may be assembled by insertion of the screws 23 through the slots into the plate 22, to hold the plates 22,24 in mutually overlapping adjustable relation. Adjustment of the side frames 18,20 to the width "W" of the rail 12 and secure tightening of the screws 23 prepares the frame 16 for use with the ladder as illustrated.

The frames 18,20 each have an extended rib portion 26, each rib portion bearing a cantilever spring 28 secured thereto, as by riveting. With the springs 28 resiliently deformed in depressed relation towards the respective rib portion 26 there is provided an aligned bore extending through the respective two rib portions 26 and two springs 28 through which a suitably sized spindle 30 may be inserted in closefitting relation.

Upon releasing the springs 28 they flex away from the respective rib portion 26 to grippingly secure the surface of spindle 30, and thus preclude axial withdrawal thereof from the rib portions 26.

Referring specifically to FIG. 1, the can holding device 32 has an extended arm 33 connected with spindle 30, extending substantially normally thereto. The remote end of arm 33 has a transversely extending bracket 34 secured thereto having upstanding peg portions 36 attached to the ends thereof.

A plate 38 has a release spring 28 secured thereto in similar relationship to that of rib portions 26 and springs 28, having a bore by which the plate 38 is slidably mounted on arm 33. A pair of mutually spaced peg portions 39, one of which only is shown project from the plate 38 towards peg portions 36. The peg portions 36,39 are particularly suited to engage the respective bottom and top rims of a paint can. Deformation of the release spring 28 towards plate 38 permits engagement of the peg portions 36,39 in gripping relation with a selected paint can in the standard size range varying from a half pint to a gallon capacity, with the can lid removed.

The plate 38 is provided with a cranked edge portion 41 which extends downwardly into the mouth of the can (shown in phantom) to provide a paint scraper whereby excess paint may be readily removed from a charged brush during withdrawal of the brush from the can.

Turning to FIG. 2, the spindle 30 forms part of a pulley block 44 having a grooved pulley wheel 46 rotatably mounted therein.

In the FIG. 3 embodiment a hook portion 48 extending from the spindle 30 provides support for articles such as a pail handle (shown in phantom).

For operation of the arrangement, it will be appreciated that rapid release of spindle 30 may be effected by gripping the opposed pair of release springs 28 in one hand to compress them, and withdrawing the spindle 30 from the device 16.

Owing to the nature of the arrangement the spindle 30 can be rotated when secured by the springs 28, so that the supported can, or pail or pulley block can take up its own alignment under gravity or other force, while the angle of the ladder also is immaterial.

The device 16 is readily repositioned from place to place on the ladder, by upward disengagement and downward repositioning in hooked engagement over a selected rung. It is not necessary to remove the respective attachment when so doing, and the device is positionable on either rail of the ladder.

Also, the spindle 30 may be inserted from either side, and the device is not left or right handed.

All of the rapid releases permit single handed disengagement, and possess a self-tightening characteristic when released.

In instances where rigid orientation of the spindle 30 in relation to the ladder is necessary, the provision is contemplated of a shaped cross-section such as square bar stock for the spindle with correspondingly shaped bores in one or more of the members 26,28.

Referring to FIG. 4 a portion 50 of a step ladder is shown being illustrated in phantom for purposes of clarity, having a top step 52 and portions of legs 54,56' illustrated. The accessory mounting device 56 has a top plate 58 with a slot wall 57 therein. A pair of angle sections 60,62 are rigidly attached to the plate 58, each having a respective spring 28 secured thereto. The illustrated bore 59 extends in aligned relation through the springs 28 and the side members of angle sections 60,62 when the springs 28 are resiliently compressed toward each other, to permit the passage therethrough of a spindle 30 in the manner illustrated in FIGS. 1, 2 and 3. Release of the springs 28 serves to secure a spindle 30 in locked engagement.

A thumbscrew 65 secures a saddle means 67 in selectively adjustable relation with the top plate 58. The saddle means 67 which is of inverted-U-shape has side frame members with toe portions 69 to engage the under surface of the respective ladder step in wedging relation therewith. The inclinations of the toe portions 69 in divergent relation from the surface of plate 58 provides a capability for wedging relation over a range of step thickness, while adjustment of the saddle means 67 by way of thumb screw 65 permits adjustment to the width of the step.

Due to the geometry of the arrangement, it is usually possible to detach the device 56 by raising the portions 60,62 to clear the step, thereby permitting the device 56 to be slid from off the step.

In considering the possible variations in the construction of the device it will be evident that a sufficient degree of attachment for the spindle 30 may be achieved by the elimination of one of the springs 28, so as to rely on the use of a single spring 28.

Similarly, in the embodiment of FIGS. 1, 2 and 3, by sacrificing the ability to attach either side frames of a ladder, a single hook portion 19 may prove acceptable in some circumstances.

Again, in the FIG. 4 embodiment, a single toe portion 69 might be acceptable in some circumstances.

In the case of the spindle 30, while arrangements illustrated one of the preferred embodiments it will be understood that the spindle alignment function of the frame side members may be provided by equivalent means.

What I claim as new and desire to secure by Letters Patent of the United States is:

1. The combination of an accessory holder and an attachment frame for use with a ladder to provide ready engagement and detachment of said attachment frame in selected alternative positioned relation on said ladder, said accessory holder having a spindle portion for transverse sliding entry and engagement with said frame, said frame comprising a pair of spaced apart side members having plate means in connecting relation extending therebetween, hook means to engage a step portion of said ladder in drop-over hooking engagement, aperture means in said frame side members in mutual aligned relation to receive said spindle member in transverse sliding relation therethrough and manually operable lock means to transversely secure said spindle member relative to said frame while permitting said accessory holder to pivot about the axis of said spindle under working loads.

2. The combination as claimed in claim 1, said connecting plate means comprising a pair of angle plates each connected to a respective said side member, said angle plates being arranged in mutual overlapping relation, and adjustable fastening means connected therebetween to permit adjustable spacing of said side members in snug fitting relation with a rail portion of said ladder, said hook means providing engagement with a rung of said ladder when said attachment frame is secured to either side rail of the ladder.

3. The combination as claimed in claim 1, said connecting plate means having said hook means adjustably secured thereto for fitting attachment to a step of said ladder.

4. The combination as claimed in claim 2, said lock means comprising a resilient spring clamp attached to each said side member, each clamp having an aperture therethrough in aligned relation with said aperture means when in a manually deflected condition, to permit transverse passage of said holder spindle portion therethrough, and flexing into gripping relation with said spindle when released, to preclude axial displacement of said spindle relative to said attachment frame while permitting relative pivoting of said spindle in load accomodating relation.

5. The combination as claimed in claim 1, said accessory holder comprising a can holding device having an arm extension connected to said spindle, extending normally thereto, a bracket extending normally to said arm having upstanding peg portions to engage a lower rim of said can, a plate member slidably mounted on said arm extension between said spindle and said bracket, manually operable release spring means secured to said plate for selective engagement with the arm to secure said plate member in abutting relation with the rim of said can, said plate having downwardly extending peg portions to engage said can in secured relation to said holding device.

6. The combination as claimed in claim 3, said lock means comprising a resilient said spring clamp attached to each said side member, each clamp having an aperture therethrough in aligned relation with said aperture means when in a manually deflected condition, to permit transverse passage of said holder spindle portion therethrough, and flexing into gripping relation with said spindle when released, to preclude axial displacement of said spindle relative to said attachment frame while permitting relative pivoting of said spindle in load accomodating relation.

* * * * *